United States Patent [19]

Jury

[11] 4,396,685

[45] Aug. 2, 1983

[54] FABRICATED EXPANDED METAL

[75] Inventor: Harold R. Jury, Glynde, Australia

[73] Assignee: Ampliform Pty. Limited, Royal Park, Australia

[21] Appl. No.: 319,784

[22] Filed: Nov. 9, 1981

[30] Foreign Application Priority Data

Nov. 13, 1980 [AU] Australia ..... PE6473

[51] Int. Cl.[3] ..... B21D 31/04; E04C 2/38

[52] U.S. Cl. ..... 428/594; 428/596; 29/6.1; 52/672; 52/816

[58] Field of Search ..... 428/582, 596, 600, 573, 428/594, 99; 52/670, 671, 672, 816, 787, 817, 826; 29/6.1; 24/293, 297; 403/381, 331, 387, 274

[56] References Cited

U.S. PATENT DOCUMENTS

| | | | |
|---|---|---|---|
| 461,881 | 10/1891 | Francis | 403/381 |
| 559,506 | 5/1896 | Swain | 403/381 |
| 885,158 | 4/1908 | Kahn | 29/6.1 |
| 889,312 | 6/1908 | Kahn | 29/6.1 |
| 945,656 | 1/1910 | White | 52/670 |
| 948,414 | 2/1910 | Clark | 52/670 |
| 1,578,416 | 3/1926 | Frease | 52/670 |
| 1,588,661 | 6/1926 | Clark | 52/672 |
| 1,680,369 | 8/1928 | Dugan | 428/582 |
| 2,083,300 | 6/1937 | Hurlbert | 52/672 |
| 2,292,372 | 8/1942 | Gerlach | 52/816 |
| 3,309,119 | 3/1967 | Phillips | 52/670 |
| 3,851,362 | 12/1974 | Jury | 29/6.1 |
| 4,132,335 | 7/1979 | Ingram | 403/331 |

OTHER PUBLICATIONS

Publication No. 21,801, Tentschert, Sep. 20, 1910, 1 p.

*Primary Examiner*—L. Dewayne Rutledge
*Assistant Examiner*—J. J. Zimmerman
*Attorney, Agent, or Firm*—Charles A. Blank

[57] ABSTRACT

An expanded metal workpiece is formed from an extrusion so as to have grooves between the beads where adjacent beads are joined by web portions, the head portions of metal inserts are then inserted into the grooves at a metal to metal joining zone, and each head is retained to the metal workpiece by metal deformation.

13 Claims, 13 Drawing Figures

FABRICATED EXPANDED METAL

This invention relates to a product made from expanded metal, and fabricated to have additional members which can for example be used as structural load-bearing members, shading members, ornamental members or the like. Another aspect of the invention relates to a method of producing such expanded metal.

BACKGROUND OF THE INVENTION

The inventor herein was the inventor in the matter of the Australian Pat. Nos. 432,124 and 434,936 standing in the name of Jury & Spiers Proprietary Limited, and Australian Pat. No. 500,092 standing in the name of Ampliform Pty. Ltd. In all of those patents, there was disclosed a product formed by the process of extruding an aluminium workpiece, slotting the workpiece and expanding it. In the first two said patents, the workpiece was flanked on each side with webs which formed the upper and lower chords of a beam, while in the third patent, the chords were absent so that the workpiece was expanded without the limitations imparted by the chords, and therefore the expansion could be increased. This further feature has proved to be commercially valuable.

One of the difficulties which was encountered with the truss-like metal member referred to in the first two said Australian patents was the limitation of the angle to which the struts could be stretched, and this was found to be insufficient to provide a useful viable truss which was competitive with certain other trusses which are available. A limitation encountered with the mesh-like member was that it had little dimensional stability, and it was not suitable, for example, for use as a load-bearing panel. Furthermore, the openings were such that the mesh-like member could sometimes be used as a ladder, for example by a child, and an accident hazard could possibly result.

The main object of this invention is to provide improvements whereby expanded metal can have additional members fabricated therein which will impart considerable strength providing load-bearing characteristics in at least one direction in one plane, and which will also reduce the opening size and thereby limit the likelihood of use in a ladder mode.

SUMMARY OF THE INVENTION

In this invention an expanded metal workpiece is formed from an extrusion so as to have grooves between the beads where adjacent beads are joined by web portions, the head portions of metal inserts are then inserted into the grooves at a metal-to-metal joining zone, and each head is retained to the metal workpiece by metal deformation. The metal deformation can be either of the head itself or of the beads where they abut the head.

With this invention, it becomes possible to impart considerable strength providing load bearing characteristics in at least one direction in one plane, and in some instances the metal inserts can so divide the openings of the expanded metal workpiece that they cease to be a hazard for children scaling a fence, for example. Surprisingly, when the metal deformation takes place, at the ends of the grooves there exist projections formed by the metal flow which inhibit longitudinal movement of the inserts with respect to the metal workpiece, such as to firmly lock the inserts with respect to the metal workpiece both against longitudinal sliding and also withdrawal. This surprising effect has the result of forming the otherwise fragile metal workpiece into a stiff and rigid truss-like member.

More specifically, in this invention fabricated expanded metal comprises expanded metal workpiece having a plurality of beads which are non-linear and are interconnected by the rows of web portions with which they define grooves, the web portions of any one row being staggered with respect to the web portions of the next adjacent row, and a plurality of metal inserts each having a workpiece retaining head contained in at least one of said grooves at a metal-to-metal joining zone where it is retained to the expanded metal workpiece by metal deformation.

As said above, the invention is not limited to a product, and in another aspect a method of reducing fabricated expanded metal comprises:

(a) Forming a workpiece of ductile metal to have a plurality of parallel beads spaced by webs to have grooves between the beads, cutting a plurality of rows of elongate slots in respective webs between the beads in a pattern wherein the slots of one row
  (i) are longer than the remaining web portions between adjacent ends of the slots, and
  (ii) are staggered with respect to the slots of the next adjacent row,
(b) moving the uppermost beads away from one another to increase the width of the workpiece, and bend the beads near the slot ends to thus form an expanded metal workpiece,
(c) inserting retaining beads of metal inserts in some at least of the grooves defined by said remaining web portions and their adjacent said beads, thereby establishing a plurality of metal-to-metal joining zones, and
(d) so deforming metal at some at least of said joining zones that the inserts are firmly secured to the expanded metal workpiece.

In some instances, metal of a head can be deformed for example by spreading apart a pair of outwardly extending portions, in turn effected by pressing downwardly, while in other instances the metal of the beads can be deformed, and for example the beads can have vertical faces which define parallel opposite walls of the groove, the head of the metal insert can be dropped into the parallel walled groove and then the metal of the beads can be deformed over the head.

BRIEF SUMMARY OF THE DRAWINGS

An embodiment of the invention is described hereunder in some detail with reference to and is illustrated in the accompanying drawings in which:

As shown in FIGS. 1, 2, 3, 4, and 5, an extrusion 20 of aluminium is formed to have beads 21, each bead 21 having a sloping surface 22 being re-entrant such that the mouth of the grooves formed between adjacent beads 21 is, in each instance, narrower than the base of the groove.

As shown in FIG. 2, a plurality of slots 23 are formed in the webs 24 which separate the beads 21, and when the outermost beads are moved away from one another, the width of the workpiece is increased, and the beads bend near the slot ends to thus form an expanded metal workpiece. At the same time as the width increases, the length reduces, the expanded metal workpiece being designated 26 in FIG. 3. The remaining web portions 24 which exist between the slots 23 define, with the re-entrant surfaces 22, a plurality of grooves designated 27 in FIG. 3.

As shown in FIG. 4, these grooves 27 retain a plurality of metal inserts 29, which, as shown in FIG. 6, form not only an ornamentation for a door 30, but also greatly stiffen and strengthen the expanded metal workpiece 26.

FIG. 5 illustrates, in an enlarged sectional view, the interengagement of the metal insert 29 in a groove 27. The metal insert 29 comprises a workpiece retaining head 32 which is of dove tail shape somewhat similar to but slightly smaller than the cross sectional shape of the groove 27, so that the member 29 can be moved lengthways in a sliding action. The outstanding portion 33 of the metal insert 29 stands above the surface of the metal workpiece 26, and by a pressing or a rolling action, the head 32 is spread so it firmly engages the re-entrant surfaces 22 of the grooves 27.

Reference is now made to a second embodiment of FIG. 7. In FIG. 7 the expanded metal workpiece 36 is generally similar to the expanded metal workpiece 26, but the grooves 27 exist on both sides of the metal workpiece. In each case there are re-entrant surfaces 22 so that all grooves defined by the remaining portions of the webs 24 after slotting are narrower at their mouths than at their bases. This enables elongate metal inserts to be inserted for example on one side and cross beams 37 on the other side.

Figure 1:
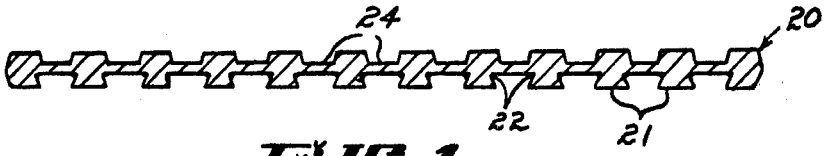
FIG. 1 is a section through an extrusion of aluminium having a plurality of "dove tail" shaped slots on one face.
Figure 2:
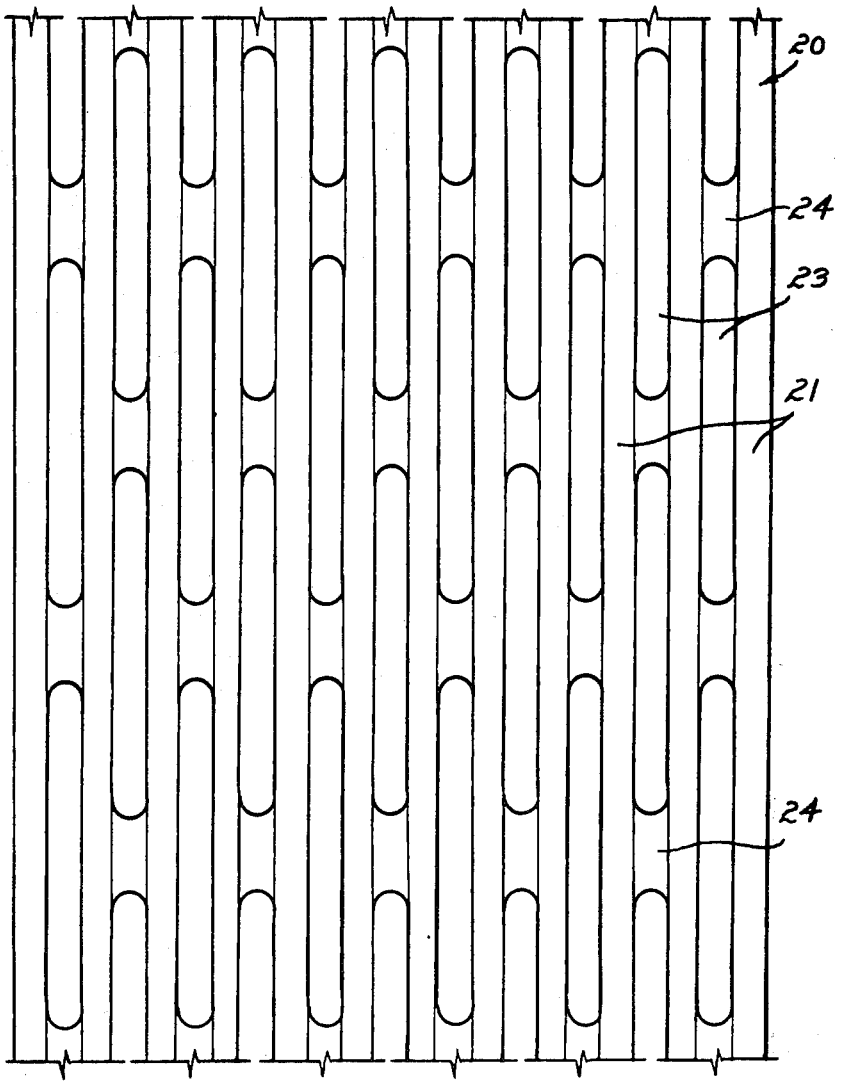
FIG. 2 is a plan view which shows the plurality of rows of elongate slots in webs between the beads.
Figure 3:
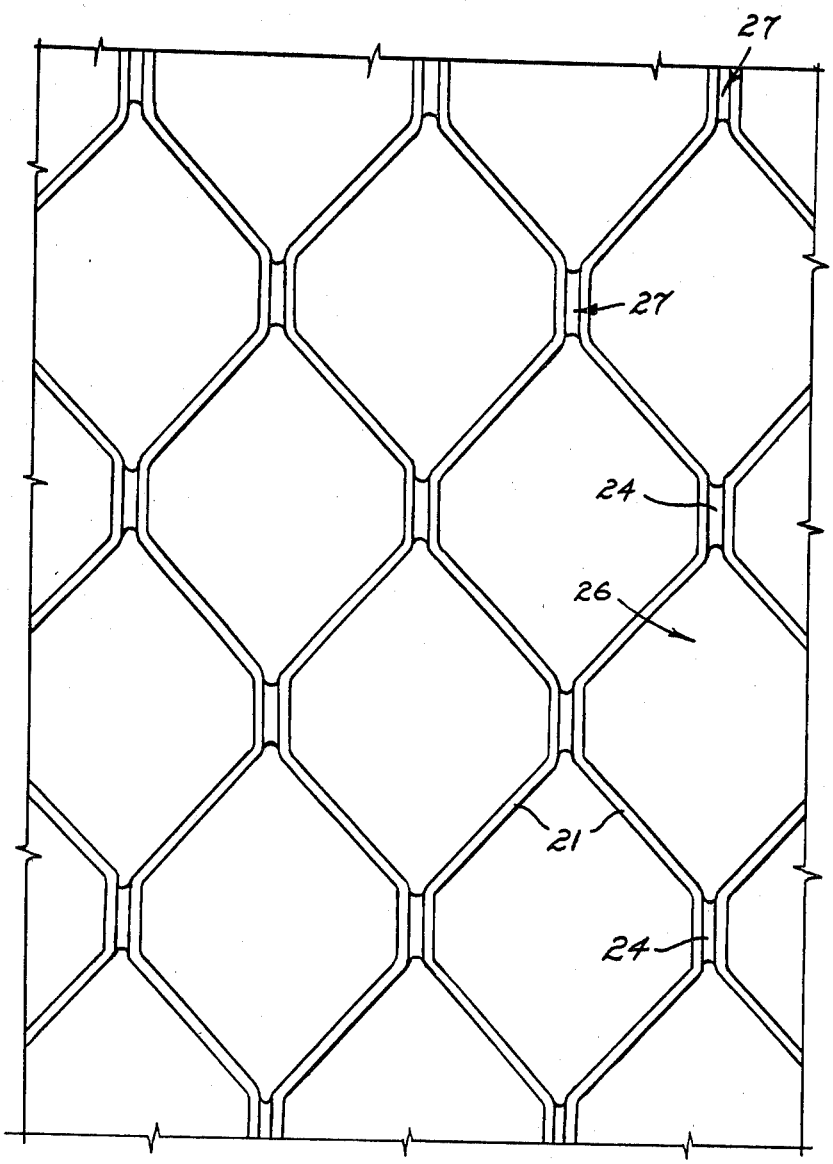
FIG. 3 is a plan view of a metal workpiece which has been expanded so that the beads are non-linear and are interconnected by rows of web portions with which they define grooves.
Figure 4:
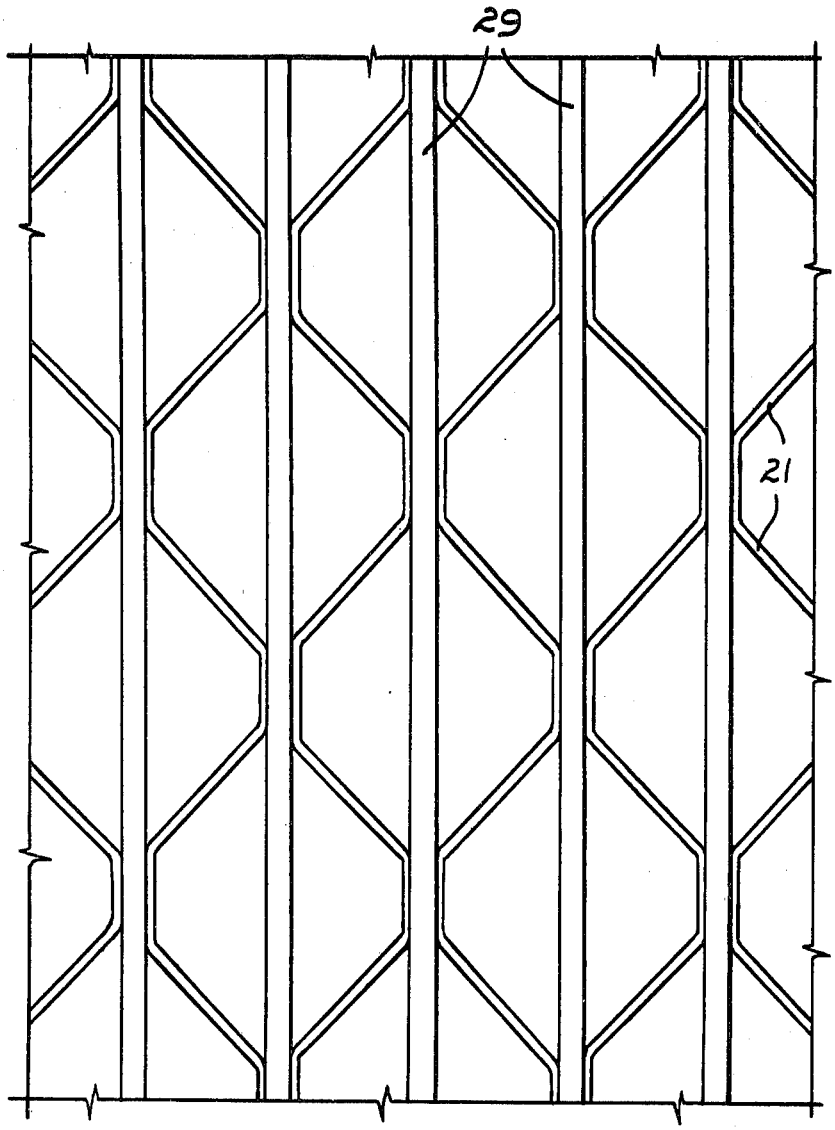
FIG. 4 is a fragmentary plan view showing the expanded metal workpiece of FIG. 3 with metal inserts therein.

Each metal insert 38 comprises a workpiece retaining head 39 for insertion into a respective groove 27, and also a projecting retention head 40.

The head 39 comprises a pair of outwardly extending and diverging portions 41 which, when they abut the web 24 and a downward force is applied to the insert 38, are caused to spread so as to firmly abut the re-entrant surfaces 22. Not only are these surfaces firmly abuted, but there is such deformation due to metal flow that movement of the metal inserts 38 in a longitudinal direction is inhibited.

The projecting retention head 40 comprises a pair of sloping surfaces 43 over which the inturned flanges 44 of the cross beam 37 can ride as the cross beam 37 is pushed downwardly, and these terminate at their inner ends in flange retaining slots 45 into which the flanges 44 can engage. Thus the suspension beam 37 (which can be made very strong for low cost) applies a stiffening across the general direction of the beads 21.

Figure 7:
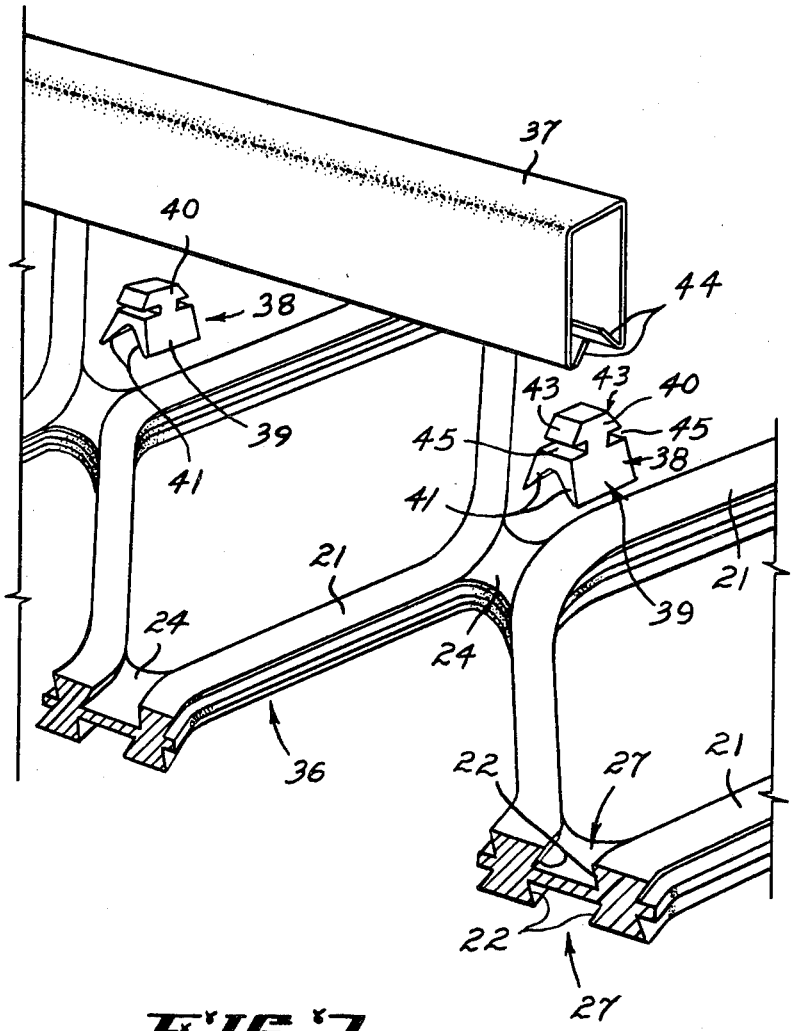
FIG. 7 is a fragmentary perspective view which shows metal inserts which are not continuous lengths, and which are interconnected by suspension beams extending transversely to the general direction of the beads.
Figure 8:
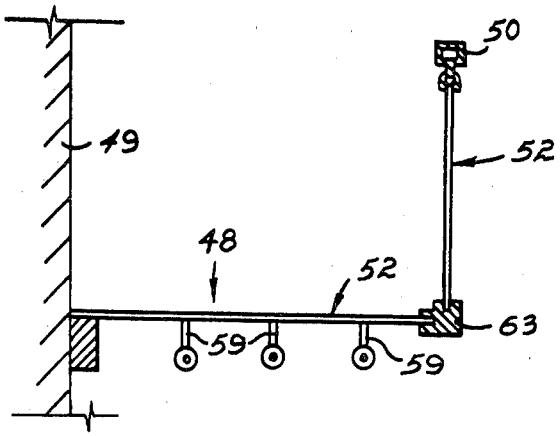
FIG. 8 is a fragmentary section through a walk-way which embodies the invention.
Figure 9:
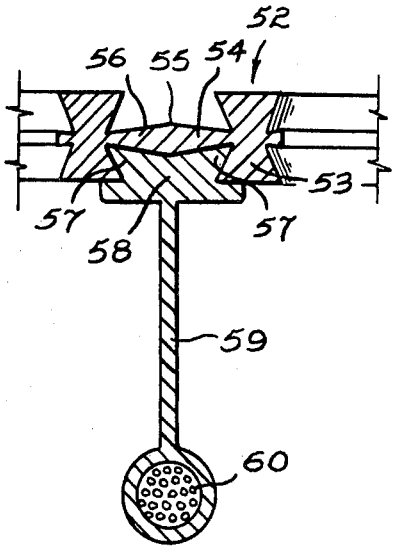
FIG. 9 is an enlarged section showing the invention using struts as the inserts, and supporting tension members.
Figure 10:
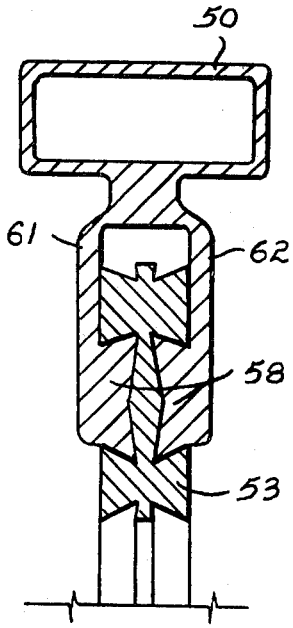
FIG. 10 is an enlarged section showing the rail arrangement of FIG. 8, FIGS. 11*a* and 11*b* are respective enlarged sections showing configuration of metal inserts and grooves before and after assembly according to a further embodiment.

The embodiment of FIGS. 8, 9 and 10 is similar in many respects to the other embodiments, and shows how the invention can be easily used in a walk-way 48. The walk-way 48 is shown extending outwardly from a wall 49, the cantilevered end being extended from a rail 50 (shown enlarged in FIG. 10). The walk-way 48 once again embodies an expanded metal workpiece, herein designated 52, in which the beads 53 are of similar cross-sectional shape to the beads in FIG. 7, but wherein each web 54 has an enlarged central portion 55 to provide a pair of downwardly and outwardly sloping surfaces 56 over which the outwardly extending portions 57 of a head 58 can slide when a strut 59 is forced against the workpiece 52. The expanded metal workpiece 52 is supported by three struts 59 arranged parallel to one another but spaced apart and beneath the workpiece 52, the struts 59 supporting tension members 60 (which in some instances can be pretensioned or post-tensioned). FIG. 10 shows the manner in which the rail 50 is retained, the rail 50 being a hollow rail and having a pair of depending flanges 61 and 62, each of which is provided with a head 58 similar in cross sectional shape to the heads 58 of the struts 59. A corner member 63 joins the two workpieces 52 in an L configuration as illustrated in FIG. 8.

Figure 5:
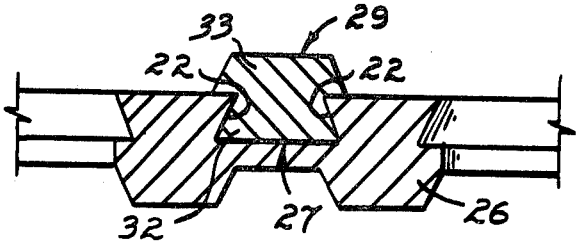
FIG. 5 is an enlarged section which illustrates the retention of the metal insert head contained in a groove at a metal-to-metal joining zone where it is retained by metal deformation.
Figure 6:
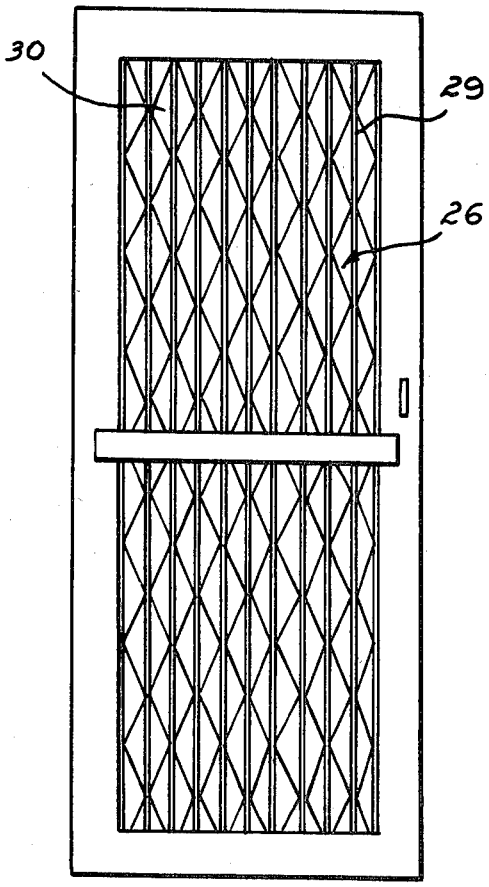
FIG. 6 is an elevation of a door which embodies the fabricated expanded metal of this invention.
Figure 11A:
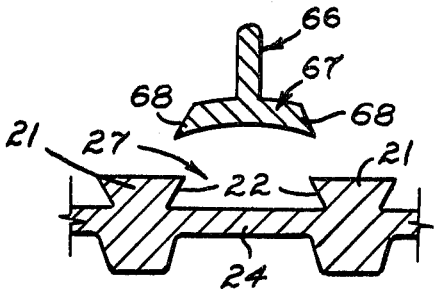
Figure 11B:
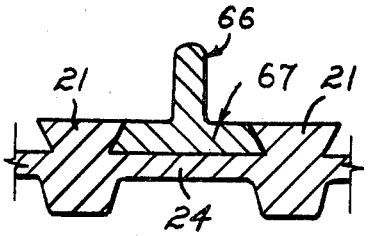

FIGS. 11*a* and 11*b* show an alternative configuration wherein the beads 21 have the cross sectional shape illustrated in FIG. 5, that is, having the re-entrant surfaces 22 defining with the web 24 a dove tail shaped groove. The metal insert 66 has a head 67 which, before insertion, comprises a pair of outwardly extending portions 68 which are spread apart when pressed into the groove 27 as shown in FIG. 11*b*. Deformation of the metal at the ends of the grooves 27 prevents any longitudinal movement of the inserts 66 after assembly.

Figure 12A:
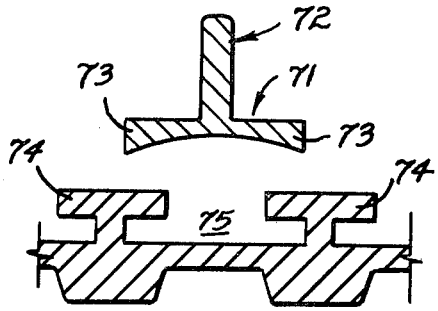
FIGS. 12*a* and 12*b* are sections showing an alternative configuration to that illustrated in FIGS. 11*a* and 11*b*, and FIGS. 13 and 13*a* are enlarged sections showing an arrangement wherein the grooved walls are parallel and have an insert positioned therein, the beads being subsequently deformed over the head of the insert.
Figure 12B:
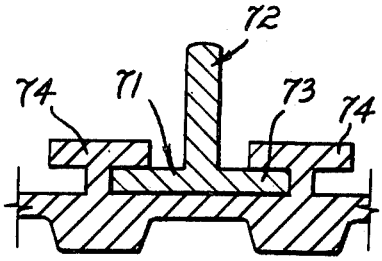

The configuration of FIGS. 12*a* and 12*b* is somewhat similar to that of FIGS. 11*a* and 11*b*, in that the head 71 of the insert 72 again has a pair of outwardly extending portions designated 73 which engage beneath the flanges 74 of T-section grooves 75.

Figure 13:
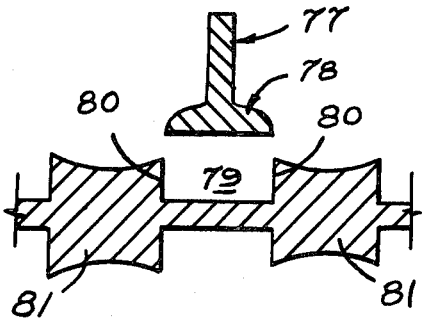
Figure 13A:
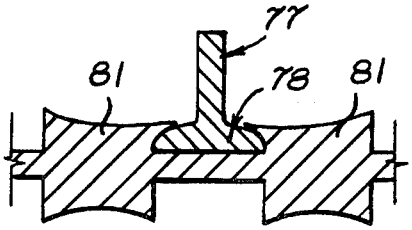

Not in all instances is it desirable to deform only the head of the insert, and in FIGS. 13 and 13*a* the insert 77 has a head 78 which is dropped into a groove 79, the side surfaces 80 of which are parallel, the surfaces 80 being of the beads 81. After having been positioned, beads 81 are so deformed that the metal flows over the top of the head 78 to firmly retain the insert 77 in position.

I claim:

1. Fabricated expanded metal comprising:

an expanded metal workpiece having a plurality of beads which are non-linear and are interconnected by rows of web portions with which they define grooves, the web portions of any one row being staggered with respect to the web portions of the next adjacent row, and a plurality of metal inserts each having a workpiece retaining head contained in at least one of said grooves at a metal-to-metal joining zone where it is retained to said expanded metal workpiece by metal deformation such that adjacent surfaces of said workpiece head and said at least one groove are brought into more intimate contact and said workpiece head is retained within said at least one groove by a mouth of said groove narrower than its base.

2. Fabricated expanded metal according to claim 1, wherein each said bead is formed with a surface which, where it faces a similar surface of an adjacent bead, is a re-entrant surface such that the mouth of each said groove is narrower than its base.

3. Fabricated expanded metal according to either claim 1 or claim 2 wherein the workpiece retaining head of each said metal insert extends through a plurality of said grooves which are in alignment.

4. Fabricated expanded metal according to claim 2 wherein each head has a pair of outwardly extending portions which abut respective adjacent said beads.

5. Fabricated expanded metal according to claim 4 wherein said metal deformation comprises the spreading apart of said outwardly extending portions.

6. Fabricated expanded metal according to claim 1 or claim 2 wherein said inserts comprise strut means and support a plurality of mutually spaced parallel tension members each of which is spaced from and retained parallel to said expanded metal workpiece by said strut means.

7. Fabricated expanded metal according to either claim 1 or claim 2 wherein each said metal insert comprises a retention head outstanding from said expanded metal workpiece, and is engaged by a further plurality of suspension beams each of which extends transversely to the general direction of said beads.

8. Fabricated expanded metal according to claim 1 wherein opposite walls of each said groove are parallel before said deformation, but said deformation is deformation of the beads over said head of each said insert.

9. A method of producing fabricated expanded metal comprising:

(a) forming a workpiece of ductile metal to have a plurality of parallel beads spaced by webs to have grooves between the beads, cutting a plurality of rows of elongate slots in respective webs between the beads in a pattern wherein the slots of any one row (i) are longer than the remaining web portions between adjacent ends of the slots, and (ii) are staggered with respect to the slots of the next adjacent row, (b) moving the outermost beads away from one another to increase the width of the workpiece and bend the beads near the slot ends to thus form an expanded metal workpiece, (c) forming a plurality of metal inserts each to have a workpiece retaining head and inserting said workpiece retaining heads in some at least of the grooves defined by said remaining web portions and their adjacent said beads, thereby establishing a plurality of metal-to-metal joining zones, and (d) so deforming metal at some at least of said joining zones, that the inserts are firmly secured to the expanded metal workpiece.

10. A method according to claim 9 wherein said forming of a workpiece comprises forming said beads with re-entrant surfaces.

11. A method according to claim 9 or claim 10 wherein said inserting of workpiece retaining heads of metal inserts comprises extending each said workpiece retaining head through a plurality of said grooves which are in alignment.

12. A method according to claim 9 or claim 10 wherein said forming of each metal insert comprises forming said workpiece retaining head to include a pair of portions which extend outwardly away from one another for the length of the workpiece, and said deforming of the metal comprises spreading apart of said outwardly extending portions.

13. A method according to claim 9 wherein said forming of said beads comprises forming opposite sides thereof to be parallel to one another, and said metal deformation is deformation of the beads over said head of each said insert.

* * * * *